United States Patent [19]

Bersonnet et al.

[11] Patent Number: 4,955,599

[45] Date of Patent: Sep. 11, 1990

[54] EXERCISE CYCLE WITH GEAR DRIVE

[75] Inventors: George Bersonnet, River Heights; William T. Dalebout, Logan, both of Utah

[73] Assignee: Proform Fitness Products, Inc., Logan, Utah

[21] Appl. No.: 299,725

[22] Filed: Jan. 19, 1989

[51] Int. Cl.[5] ..... A63B 21/00

[52] U.S. Cl. ..... 272/73

[58] Field of Search ..... 272/73, 128, 71, 72

[56] References Cited

U.S. PATENT DOCUMENTS

| | | | |
|---|---|---|---|
| D. 278,268 | 4/1985 | Kiiski | D21/194 |
| 334,635 | 1/1886 | Bowen | 272/73 |
| 3,578,800 | 5/1971 | DiNepi | 272/73 |
| 4,007,927 | 2/1977 | Proctor | 272/73 |
| 4,533,136 | 8/1985 | Miller et al. | 272/73 |
| 4,586,706 | 5/1986 | Chen | 272/73 |
| 4,673,177 | 6/1987 | Szymski | 272/73 |
| 4,705,493 | 11/1987 | Lin | 272/73 |
| 4,779,863 | 10/1988 | Yang | 272/73 |
| 4,809,970 | 3/1989 | Berstegui | 272/73 |

*Primary Examiner*—Stephen R. Crow

*Attorney, Agent, or Firm*—Trask, Britt & Rossa

[57] ABSTRACT

An exercise cycle has an upright member with a drive axle and an idler axle each having drive sprockets and idler sprockets interconnected and all positioned within the rim of a flywheel and within the coacting cover which together with the flywheel forms a thin cylinder about the upright member of the exercise cycle.

5 Claims, 3 Drawing Sheets

EXERCISE CYCLE WITH GEAR DRIVE

BACKGROUND OF THE INVENTION

1. Field:

This invention relates to exercise cycles and more particularly to an exercise cycle having a flywheel and a gear system for operating the flywheel.

2. State of the Art:

Stationary exercise cycles are well known and widely available in a variety of configurations. Exercise cycles rudimentarily include a frame and pedal structure connected by a drive mechanism to rotating structure to provide resistance upon operation of the pedals. For example, U.S. Pat. No. 4,533,136 (Smith, et al.) shows an exercise cycle with pedals interconnected to a flywheel which has a resistance strap so the user may adjust the degree of resistance to rotation of the flywheel and in turn the degree of difficulty desired by the user.

U.S. Pat. No. 4,657,244 (Ross) shows one form of exercise cycle in which pedals are interconnected through a gearing arrangement to a flywheel structure. In addition it has handles which rotate or reciprocate with rotation of the gears. U.S. Pat. No. Des. 278,268 (Kiiski), U.S. Pat. No. Des. 280,923 (Smith, et al), U.S. Pat. No. Des. 281,520 (Kiiski), and U.S. Pat. No. Des. 281,711 (Hiivola) show other forms or configurations of exercise cycles.

An exercise cycle of the type having a flywheel operated by a compact drive structure and having an improved structural arrangement to contain the drive mechanism has been heretofore unknown.

SUMMARY OF THE INVENTION

An exercise cycle has a frame for positioning on a support surface. Seat means are attached to the frame to support a user. A drive axle with a first drive sprocket is rotatably secured to the frame. An idler axle with an idler sprocket smaller than the first drive sprocket is rotatably secured to the frame spaced from the drive axle. Drive means drivingly interconnects the first drive sprocket and the first idler sprocket to cause the first idler sprocket to rotate upon rotation of the first drive sprocket. A second idler sprocket larger in diameter than the first idler sprocket is adapted to the idler axle to rotate therewith. A flywheel is mounted to rotate about the drive axle. The flywheel has a second drive sprocket attached which is smaller in diameter than the second idler sprocket. Pedal means are adapted to the drive axle to rotate the sprockets and in turn to cause the flywheel to be rotated. Resistance means are adapted to the frame to provide resistance to the rotation of the flywheel.

In a preferred embodiment the flywheel has a rim about its perimeter. The first drive sprocket, first idler sprocket, second idler sprocket and second drive sprocket are all sized to fit within the rim of the flywheel. The flywheel is desirably formed to have a hollow disc or recess with the rim positioned about the perimeter of the flywheel.

Preferably the frame has a base member and an upwardly extending center member with a drive axle housing and an idler axle housing adapted to the upwardly extending center member.

The resistance means preferably includes a bracket secured to the frame and a brake adjustably attached to the bracket with control means having one end positioned for operation by a user positioned on the seat and another end connected to cause the brake means to be urged against the flywheel and preferably the rim. The rim of the flywheel desirably has an interior or inside surface. The brake is positioned to contact the interior surface of the rim. The flywheel is desirably substantially solid with the rim unitarily formed therewith to form a hollow portion oriented toward the upwardly extending center member. Most preferably the exercise cycle includes a flywheel cover sized to cover the entire hollow portion of the flywheel secured to the frame.

In one embodiment the brake means includes operation means positioned proximate the flywheel cover. In an alternate embodiment brake means includes operation means adapted to handle means for operation by the user to urge the brake toward the inside rim of the flywheel.

In a desired embodiment the flywheel is rotatably mounted to the central upright member to rotate about an axis transverse thereto. The flywheel cover and the flywheel are each substantially circular in projection and sized to proximately fit together to form a thin cylinder with the upright member extending therethrough and with the drive means positioned within the cylinder.

BRIEF DESCRIPTION OF THE DRAWINGS

In the drawings, which illustrate the best mode presently contemplated for carrying out the invention.

DESCRIPTION OF THE ILLUSTRATED EMBODIMENTS

Figure 1:
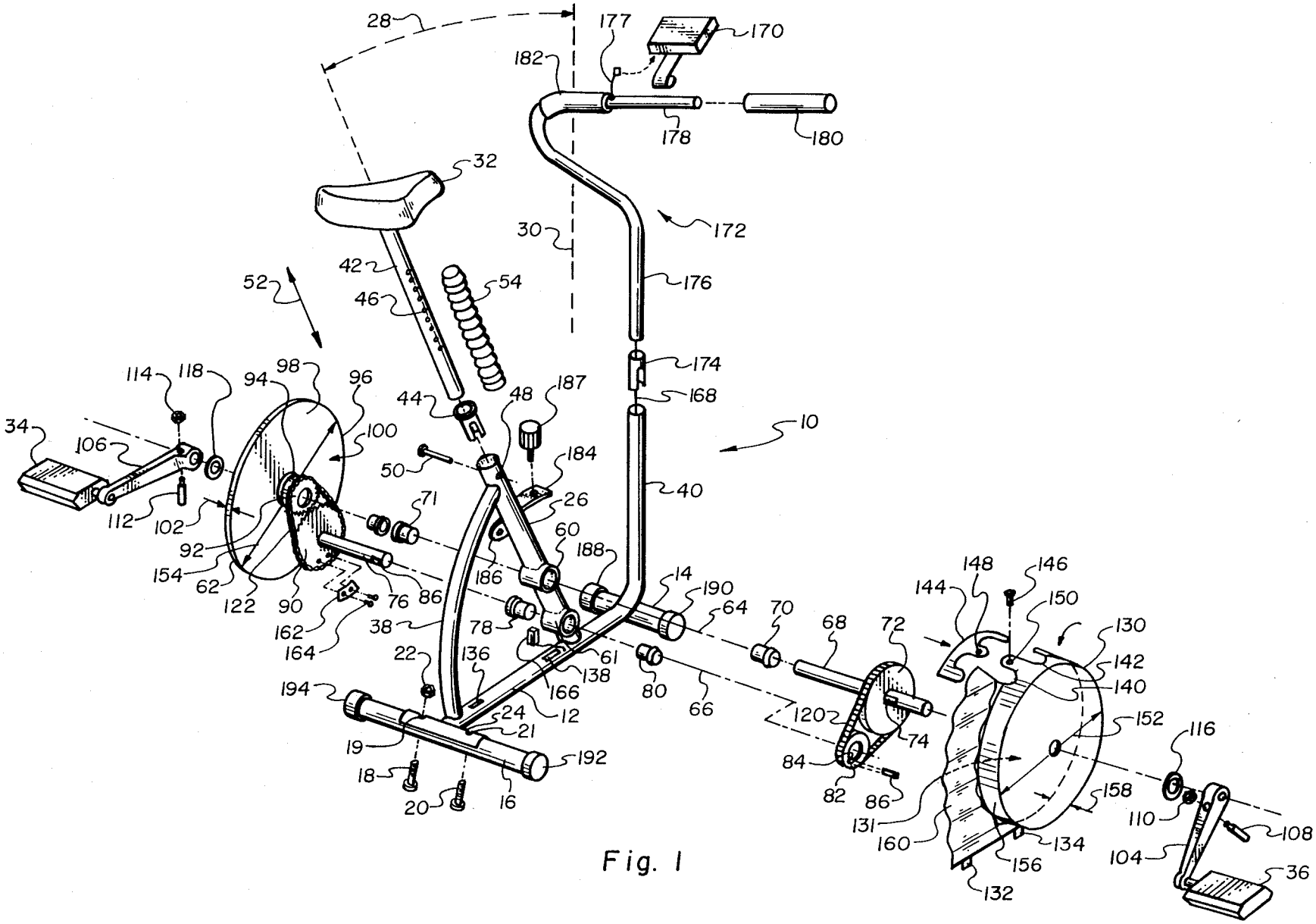
FIG. 1 is an exploded perspective view of an exercise cycle of the instant invention.

FIG. 1 is an exploded view of an exercise cycle 10 which includes a frame for positioning on a support surface. The frame has a base member 12, front foot support 14 and rear support 16. The front support 14 is adapted to the base 12 by any acceptable means. In the embodiment of FIG. 1, the front support 14 is attached to the base 12 by welding. However, the rear support 16 is attached to the base 12 by use of bolts 18 and 20 which pass through apertures (not shown) in the support 16 and apertures 19 and 21 formed in bracket 24. The bracket 24 is in turn welded to the frame or base 12. The bolts 18 and 20 interconnect with nuts such as nut 22 to secure the support 16 to the bracket 24.

The frame of the cycle 10 also includes an upwardly extending central member 26 which is shown welded to the base 12. The upwardly extending central member 26 is shown positioned at a preselected angle 28 from the vertical 30. The angle 28 may vary as desired by the user from a few degrees to as much as 45 degrees. The central member 26 is regarded to be upright or extending upwardly so long as the user positioned on the seat 32 may place his or her feet on the pedals 34 and 36 which are below the lower portion or pelvic region of the user's body so the user may be regarded to be sitting in a generally upright position when on the seat 32 as opposed to being in an inclined or reclining position. However, it should be understood that the principles of the invention may be readily used for other forms of exercise cycles such as recumbent cycles.

The frame also includes a support member 38 which is here shown welded to the central member 26 and to the base 12 to provide support and strength to the angulated central member 26. The base 12 is here shown being unitarily formed with a member 40 which extends uprightly for further connection with handle means as more fully discussed hereinafter.

Seat means are provided to support a user. The seat means illustrated includes a seat 32 which is sometimes referred to as a saddle. It is securely connected to a seat post 42 which is sized and configured to pass through a coupling 44 for interconnection into the central member 26. That is, the seat post 42 slides or telescopes into the central member 26. A plurality of apertures 46 are formed in the seat post 42. Upon positioning the seat post 42 into the central member 26, one of apertures 46 is placed in alignment with corresponding aperture 48 formed in the central member 26 so that a pin 50 may be inserted. The overall height 52 of the seat may thus be adjusted to accommodate users of differing height. The pin 50 may be a simple pin, a nut and bolt, or other arrangement as desired by the user. An expansion collar 54 may be provided and positioned over the seat post 42 to prevent any lubrication which may be placed upon the post 42 from contacting the user or the user's clothes.

As can be seen in FIG. 1, a first drive axle housing 60 is secured to the frame. It is here secured to the central member 26 and spaced an appropriate distance above the base 12 so that the flywheel 62 may be mounted without contacting the support surface. An idler axle housing 61 is also secured to the central member 26. It is also spaced from the drive axle housing 60 a distance selected so that the sprockets and other drive components fit within the flywheel as discussed hereinafter.

The drive axle housing 60 has an axis 64; and the idler axis housing has an axis 66 both of which are in general alignment. As shown in FIG. 1, the drive axis 64 and idler axis 66 are desirably parallel and transverse to the central member 26.

A drive axle 68 is rotatably secured to the frame as shown here by positioning it through the drive axle housing 60. To facilitate rotation, the drive axle 68 is supported by a right drive bushing 70 and a left drive bushing 71 both of which are sized to snugly fit within the drive housing 60 and sized to receive the drive axle 68 to support the drive axle 68 and provide a rotating bearing surface for the drive axle 68. A first drive sprocket 72 is secured to the drive axle 68. It may be secured by any conventional means including the use of locking rings or the use of a slot and key 74 as depicted in FIG. 1.

An idler axle 76 is rotatably attached to the frame and more particularly to pass through the idler housing 61. A left idler bushing 78 and right idler bushing 80 are sized to fit within the idler housing 61. The idler axle 76 is positioned through idler housing 61 and rotatably supported by the bushings 78 and 80. A first idler sprocket 82 is connected to the idler axle 76 by a slot 84 formed in the axle 76 and a corresponding key 86. Thus the idler sprocket 82 rotates with the idler axle 76.

A second idler sprocket 90 is attached to the idler axle 76 and is also secured thereto by any readily available or desired means such as a slot and key (not shown) to rotate with the axle 76.

The second drive sprocket 92 is secured to the flywheel 62 to rotate therewith. As here shown, the sprocket 92 is secured to an extension sleeve 94 integrally formed with the flywheel 62 to rotate therewith. The sprocket 92 is secured to the sleeve 94 by locking rings or by any other means as desired by the user. Thus, rotation of the sprocket 92 in turn causes rotation of flywheel 62 which is here shown to be a substantially flat disc having a rim 96 positioned about its perimeter. The flywheel 62 is circular in projection with the rim 96 secured or integrally formed with the disc portion 98 of the flywheel. The rim 96 is formed to have a transverse dimension 102 to receive the drive mechanism as more fully discussed hereinafter.

As here shown initially, pedal means are adapted to the drive axle 68. The pedal means are here comprised of a right crank arm 104 with a pedal 36 affixed or secured thereto, the left crank arm 106 has a left pedal 34 secured thereto. The right crank arm 104 is secured to the drive axle 68 by a pin 108 and nut 110 arrangement. Similarly, the left crank arm 106 is secured to the drive axle 68 by a pin 112 and nut 114. Wear bushings 116 and 118 are provided to provide for ease of rotation of the pedals.

The pedal means and in turn the drive axle 68 are both positioned so that a user sitting upon the seat or saddle 32 may position his or her feet upon the pedals 34 and 36 and rotate them using a pedaling motion to in turn cause rotation of the first sprocket 72 which is drivingly interconnected to the idler sprocket 82 as here shown by a link chain 120. The idler sprocket 82 is sized smaller than the drive sprocket 72. Thus upon rotation of the drive axle 68 and the drive sprocket 72, the first idler sprocket 82 and in turn idler axle 76 will rotate at some amplified rpm at a ratio selected by the user. The ratio is of course determined by the selection of the diameter of the drive sprocket 72 and the diameter of the idler sprocket 82. In the embodiment illustrated in FIG. 1, the ratio is approximately 2 to 1. That is, the drive sprocket 72 has a diameter twice the diameter of the first idler sprocket 82.

The rotation imparted to the idler axle 76 is obviously transmitted to the second idler sprocket 90 which is drivingly interconnected with the second drive sprocket 92. As here shown, link chain 122 interconnects the second idler sprocket 90 with the second drive sprocket 92 to transmit rotational motion from the idler shaft to the second drive sprocket and in turn to the flywheel 62.

The second idler sprocket 90 and the second drive sprocket 92 are also sized differently and preferably in a ratio the same as the 2:1 ratio of the first drive sprocket and the first idler sprocket as hereinbefore stated. The ratio between the first drive sprocket 72 and the first idler sprocket 82 and also between the second idler sprocket 90 and the second drive sprocket 92 may be selected as desired by the user to vary or to provide for an appropriate rpm multiplication and in turn inertia/resistance as the user operates the pedals 34 and 36 to cause the flywheel 62 to rotate.

A cover 130 is also shown in FIG. 1. It is sized to fit over the first drive sprocket 72 and the first idler sprocket 82 onto the frame and more particularly the base 12 and the central member 26. The cover 130 has a hollow portion or recess 131 to receive the sprockets 72 and 82. The cover 130 is secured to the base 12 and to the upright member 26 by tabs 132 and 134 which register with and slide into slots 136 and 138 formed in the base 12. Two recesses 140 and 142 are formed in the cover 130 to register with the support member 38 and the upright member 26. A locking piece 144 also registers with the support member 38 and the upright member 26 and is secured to the cover 130 by screw 146 passing through apertures 148 and 150 when placed in registration with each other.

Figure 2:
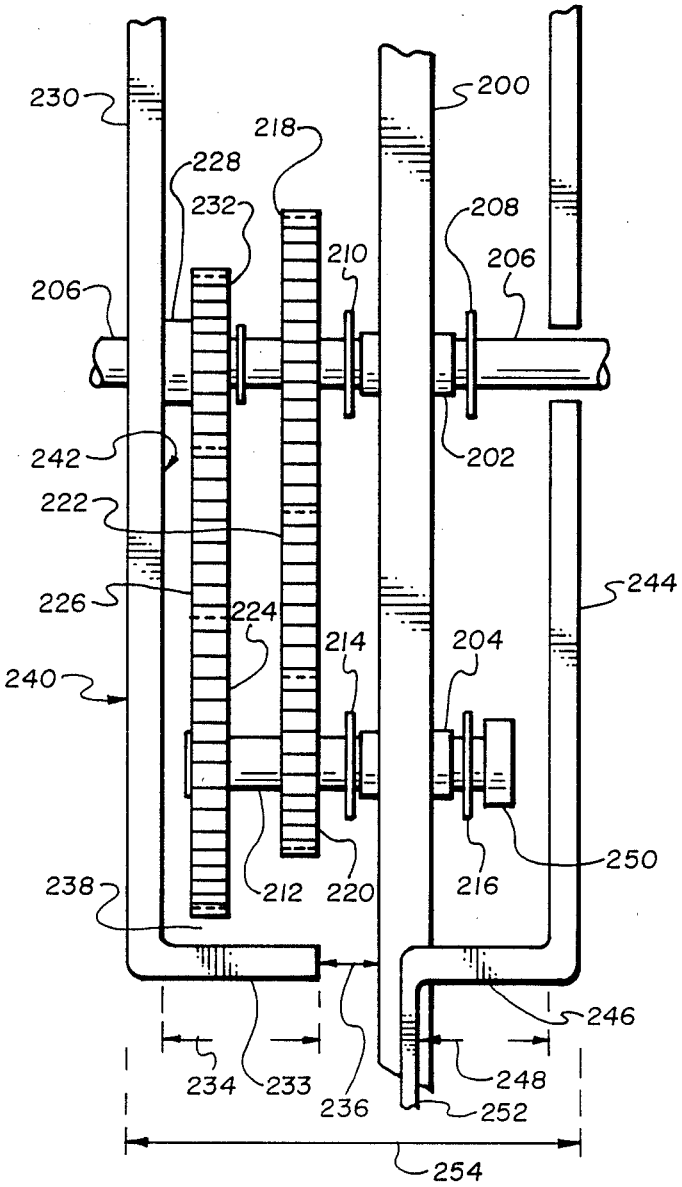
FIG. 2 is a partial cross-sectional depiction of an alternate gear or drive structure for use with the instant invention.

The diameter 152 of the cover is selected to be substantially the same as the diameter 154 of the flywheel 62 so that upon assembly, the outer rim 96 of the flywheel 62 is in substantial alignment with a similar rim structure 156 of the cover 130 to form what may be viewed as a thin cylinder with the height or thickness of the cylinder being substantially the sum of the thickness 102 of the flywheel 62 plus the thickness 158 of the cover 130 with some spacing of the flywheel rim 96 similar to the spacing shown and described with respect to FIG. 2. The cover 130 has a tail structure 160 which is attached to the cover 130 to fill the space between the support 38 and the flywheel 62 for aesthetic appearance if desired.

In FIG. 1, magnet 162 maybe attached to the second idler sprocket 90 by screws 164. A reed switch 166 is positioned or secured to the base 12 by a screw, by glue or by any other desired means to open and close upon passage of the magnet 162 therepast. As a result a rotation or rpm reading is obtained and transmitted via conductor 168 through the hollow upright member 40 and from thence to a control console 170.

The base 12 and its upright member 40 are here shown formed from a hollow metal tube. A handlebar structure 172 is attached to the upright member 40 with a sleeve 174 sized to telescopingly receive a handle extension 176 which is further interconnected and unitarily formed into a transverse handlebar structure 178. The wire 168 passes through the coupling 174 and the hollow handlebar structure 176 to be threaded out and further interconnected 177 into the control console 170 to provide signals reflective of the revolutions of the second idler sprocket. In conjunction with time circuits in the control console 170 the user can be provided with a readout in revolutions per minute or in any other particular time based function desired by the user. The transverse handle structure 178 has a convenient grip 182 attached thereto which may be a sponge rubber or similar soft structure selected for comfort by the user when grasping the handle structure 172.

As shown in FIG. 1, a support flange 184 and a pivot flange 186 are secured to the upright member 26 by welding. The brake mechanism or resistance mechanism is attached to the pivot flange 186 to rotate thereabout. Rotational movement is effected by operation of a knob 187 which interconnects with the brake structure through the flange 184 as better illustrated and described with respect to FIG. 3.

It may further be noted in FIG. 1 that the front foot 14 has a left end cap 188, a right end cap 190. The end caps 188 and 190 are preferably made from a material more resilient than metal such as plastic, rubber or some similar material. Also the end caps 188 and 190 may rotate about the foot 14 which is cylindrical to act in effect as wheels to facilitate movement of the cycle 10. The end caps 192 and 194 of the rear foot support 16 may be similar to the end caps 188 and 190.

Referring now to FIG. 2, the central or upright member 200 is shown with a drive housing 202 and an idler housing 204. A drive axle 206 passes through the drive housing 202 and is rotatably supported therein by bushings 208 and 210. Similarly, idler axle 212 is rotatably supported in the idler housing 204 by bushings 214 and 216. A first drive sprocket 218 is adapted to the drive shaft 206 to be rotated thereby upon operation of pedals not here shown in FIG. 2 but similar to pedals 34 and 36 connected to the drive shaft 206 in a manner similar to that shown in FIG. 1. The first sprocket 218 is drivingly interconnected to the first idler sprocket 220 as here shown by a drive link chain 222. The first idler sprocket 220 is secured to the idler axle 212 to rotate therewith and in turn to cause rotation to second idler sprocket 224. Second idler sprocket 224 is drivingly interconnected by a drive chain 226 to a second drive sprocket 232 which is fixedly secured to a flywheel 230 to cause rotation thereof. That is, the second drive sprocket 232 is connected to the flywheel 230 by a sleeve 228 fixedly secured to the flywheel 230.

Flywheel 230 of FIG. 2 also has a rim 233 which has a width 234 selected so that the rim 233 extends close to the upright member 200 with some clearance 236 to provide for rotation without contact with the upright member 200.

The flywheel 230 of FIG. 2 is shown having a substantially uniform thickness in cross section to reflect that a preferred flywheel 230 is preferably a cast metal structure with the rim 233 unitarily formed to provide for a recess 238 to receive sprockets 218, 220, 224, and 232 therewithin. The preferred flywheel 230 is unitarily cast out of aluminum with a finished exterior surface 240 and an unfinished interior surface 242. A cover 244 is secured to the frame similar to the cover 130 of FIG. 1. The cover 244 has a rim portion 246 which has a thickness 248 selected to be substantially similar to the thickness 234 for aesthetic reasons and also to cover the shaft end fastener 250 of the idler shaft 212. The cover 244 here shown also has a tail structure 252 for aesthetic reasons similar to tail structure 160 of the cover 130 in FIG. 1.

It may be noted that in FIG. 2, the sprockets 218, 220, 224 and 232 are all positioned on one side of the upright member 200. Alternately they may be positioned one on one side and one on the other side comparable to that shown in FIG. 1. Also, it may be noted that the sprockets 218 and 220 are drivingly interconnected by a drive chain 222. Alternately, it may be noted that the sprockets 218 and 220 may be sized to be in physical contact and to in effect be gears that are intermeshed to provide the driving relationship. Similarly, sprockets 224 and 228 are drivingly interconnected and may be in effect be gears which are physically intermeshed to provide the driving relationship.

It may further be noted from FIG. 2 that with the cover 244 in place, the cover 244 in combination with the flywheel 240 in effect forms a thin cylinder. That is, the cylinder has a small height 254 and a diameter which is the diameter of flywheel 230. All of the drive structure except the pedals are contained within the thin cylinder thus formed.

Figure 4:
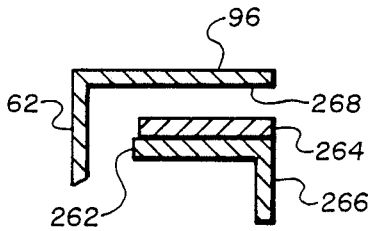
FIG. 4 is a partial cross-sectional depiction of the brake structure for use with the cycle of FIG. 1.
Figure 3:
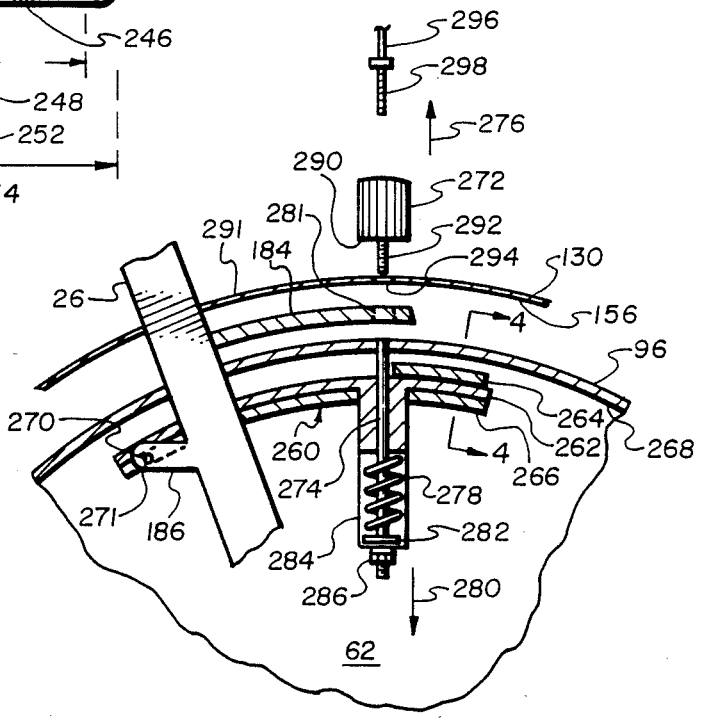
FIG. 3 is a side view of the brake structure suitable for use with the cycle of FIG. 1.

Referring now to FIG. 3, brake structure for use with the device of FIG. 1 is shown. A portion of the central member 26 is shown with the brake support flange 184 secured thereto and the pivot flange 186. The brake member 260 has an upper flat surface 262 with a brake material 264 secured thereto by conventional means such as glue. A support lip 266 is best seen in FIG. 4 which is a partial cross section of the brake structure shown in FIG. 3. The rim 96 of the flywheel 62 is here shown spaced from the brake material 264 simply for clarity for illustration. In practice the brake material 264 is closely proximate the inner surface 268 of the rim 96 to provide for friction and resistance.

In FIG. 3, it can be seen that the brake plate 262 is secured to the upright member 26 at the pivot flange 186 to rotate about a pivot 270 which is a bolt that passes through an aperture 271 formed in the pivot flange 186 and a corresponding aperture formed in the brake member lip 266. The brake material 264 is brought into contact with the inner surface 268 of the rim 96 by operation of the control knob 272 which is connected to shaft 274 to cause the plate 262 to move upwardly 276 against the spring pressure of the spring 278 which is urging the shaft 274 downward 280. A flange 282 is secured to the shaft 274 to interact with the spring 278. The shaft 274 is secured to the spring housing 284 by locknuts 286.

To operate the brake mechanism shown in FIGS. 3 and 4, the knob 272 passes through aperture 281 for a threaded interconnection with the shaft 274. Rotation of the knob 272 causes the shaft to be moved outward or upward 276 to in turn move the brake material 264 against the interior surface 268 of the rim 96.

The spring 278 urges the shaft downward 280 and in turn holds the underside 290 of the knob 272 firmly against the outer surface 291 of the housing 130. That is, the shaft 292 of the knob 272 passes through an aperture 294 formed in the housing 130 and in turn pass through the aperture 288 for interconnection with the shaft 274. The underside of the knob 290 is snugly held against the outer surface 291 of the housing 130 and more to prevent movement of the knob 272 and a change of the resistance which is selected by the user upon rotation of the knob 272. Rotation of the knob causes the brake material 264 to be urged against the interior surface 268 in an increasing fashion to provide an increasing level of resistance as desired by the user.

As an alternate arrangement, pivot flange 186 may be positioned proximate the juncture of the central member 26 and the base 12 (FIG.1) so that movement in the outward direction 276 is in effect downward toward the base 212. Movement of the shaft 274 in the outward direction 274 as just described is effected by a wire cable 296 which is threaded by a shaft 298 onto the shaft 274. The cable 296 is thereafter threaded through the interior of the hollow base 12 and the upright member 40 through the handle 172 to an alternate knob arrangement as shown in FIG. 5.

Figure 5:
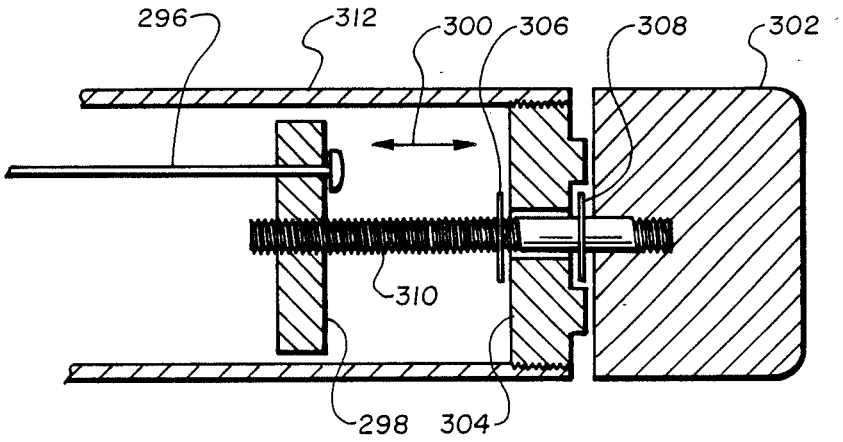
FIG. 5 is a cross-sectional depiction of alternate control means for use with brake structure comparable with the brake structure of FIG. 3.

In FIG. 5, a cable 296 is connected to a cable plate 298 which is caused to move axially 300 by operation of a control knob 302. The control knob is held secured to a threaded base 304 by locking rings 306 and 308. Therefore upon rotation of the control knob 302 the threaded shaft 310 moves the cable plate 298 axially 300 and in turn causes the wire 296 to be moved to in turn cause the brake such as the brake structure of FIGS. 3 and 4, and more particularly the brake material 264, to be urged against the interior surface 268 of the rim 96. The knob 302 and its base 304 are threadedly secured to the end of handle structure 312 similar to handle structure 178 of FIG. 1.

As can be seen from FIG. 1, with the exercise cycle of the instant invention assembled, the user may reside upon the seat 32 and operate the pedals such as pedals 34 and 36 to cause the flywheel 62 to rotate. All of the drive structure is contained within the perimeter of the flywheel and more particularly within the rim and the recess formed by the combination of the rim and the flywheel structure. The drive structure may also be contained within the recess of the cover which interacts with the flywheel and more particularly the rim of the flywheel to form a thin cylinder in appearance.

It may be noted that the embodiments herein described are purely illustrative of the application of the principals of the invention. Reference herein to details of the illustrated embodiment is not intended to limit the scope of the claims which themselves recite those features regarded as essential to the invention.

What is claimed is:

1. An exercise cycle comprising:

a frame for positioning on a support surface, said frame including a base member juxtaposed between a front support member and a rear support member, and a center member extending upward from said base member;

seat means attached to said frame to support a user thereon;

a drive axle rotatably secured to said center member above said base member to extend outwardly therefrom;

a first drive sprocket secured to said drive axle for rotation therewith;

an idler axle rotatably secured to said center member to extend outwardly therefrom and spaced from and substantially parallel to said drive axle;

a first idler sprocket smaller in diameter than said first drive sprocket and mounted to said idler axle to rotate therewith;

a first drive means drivingly interconnecting said first drive sprocket and said first idler sprocket to cause the first idler sprocket to rotate upon rotation of said first drive sprocket;

a second idler sprocket larger in diameter than said first idler sprocket and adapted to said idler axle to rotate therewith;

a flywheel mounted to rotate about said drive axle, and formed to have preselected inertia, said flywheel being substantially circular in projection and having a rim and also formed with a hollow portion oriented toward said center member;

a second drive sprocket drivingly attached to said flywheel, said second drive sprocket being sized smaller in diameter than said second idler sprocket;

a second drive means drivingly interconnecting said second idler sprocket and said second drive sprocket to cause said second drive sprocket to rotate upon rotation of the second idler sprocket;

wherein said first drive sprocket, said first idler sprocket, said second idler sprocket, and said second drive sprocket are sized to all fit within said rim of said flywheel;

pedal means adapted to said drive axle for rotation by the feet of a user positioned on said seat means;

resistance means adapted to the frame to cause resistance to the rotation of said flywheel; and a handle member secured to said frame at said front support member and extending upwardly to present a handle grip positioned to be grasped by a user positioned on said seat means.

2. The exercise cycle of claim 1 wherein said handle grip has an end and wherein said resistance means includes:

a bracket secured to said frame;

a brake adjustably attached to said bracket to be selectively positioned against said rim;

a knob rotatably secured to said end of said handle grip; and linkage means for mechanically connecting said knob with said brake to urge said brake against said rim upon rotation of said knob.

3. The exercise cycle of claim 2 wherein rim has an inside surface, wherein said brake is interior said rim.

4. The exercise cycle of claim 1 further including a flywheel cover secured to said frame opposite said flywheel and sized and configured to have substantially the same projection as said flywheel and to extend substantially across said center member and in proximity to said rim.

5. An exercise cycle, comprising:

a frame for positioning on a support surface, said frame including:

a front support member, a rear support member, a base member extending between said front support member and said rear support member, and a central upright member extending upwardly from said base member at a preselected angle toward said rear support member;

seat means attached to said central upright member to support a user thereon;

a flywheel rotatably mounted to said central upright member above said base member to rotate about an axis transverse thereto, said flywheel being substantially circular in cross-section and having a rim at its perimeter configured and positioned to form a recess on the inside side of the flywheel proximate said central upright member;

drive means attached to said central upright member sized to be within said recess and drivingly interconnected to said flywheel to cause rotation thereof;

pedal means adapted to said drive means to operate the drive means to cause flywheel rotation, said pedal means having pedals positioned for operation by the feet of a user on the seat means; and a cover attached to said frame and being substantially the same as said flywheel in cross-section and configured to extend substantially across said central upright member to define, in association with said flywheel, a thin cylinder with said central upright member extending therethrough.

* * * * *